United States Patent [19]

Sando et al.

[11] 4,426,746

[45] Jan. 24, 1984

[54] METHOD AND DEVICE FOR SEALING A HIGH PRESSURE STEAMER

[75] Inventors: Yoshikazu Sando; Susumu Niwa; Hiroshi Ishidoshiro, all of Wakayama, Japan

[73] Assignee: Sando Iron Works Co., Ltd., Wakayama, Japan

[21] Appl. No.: 285,458

[22] Filed: Jul. 21, 1981

[30] Foreign Application Priority Data

Jul. 30, 1980 [JP] Japan ..... 55-104647
Jul. 30, 1980 [JP] Japan ..... 55-104648

[51] Int. Cl.[3] ..... D06B 23/18
[52] U.S. Cl. ..... 8/149.3; 68/5 E
[58] Field of Search ..... 8/149.3; 68/5 D, 5 E; 34/242

[56] References Cited

U.S. PATENT DOCUMENTS 3,343,378 9/1967 Hayman ..... 68/5 E
3,349,578 10/1967 Greer et al. ..... 68/5 E
3,351,348 11/1967 Dupuis ..... 34/242 X
4,064,713 12/1977 Sando et al. ..... 68/5 E
4,262,377 4/1981 Sando et al. ..... 68/5 E X

FOREIGN PATENT DOCUMENTS 292564 6/1928 United Kingdom ..... 34/242

*Primary Examiner*—Philip R. Coe
*Attorney, Agent, or Firm*—Toren, McGeady and Stanger

[57] ABSTRACT

A method of and device for sealing a high pressure steamer for the continuous wet heat treatment of a cloth utilizes a steamer body provided with a seal mechanism consisting of a pair of seal rubber rolls located at the cloth inlet and the cloth outlet thereof, and includes filling a gas having a density heavier than air in a cloth passage into and out of the steamer body and providing a gas body between each of the cloth inlet and the cloth outlet and the cloth passages into the steamer body with the seal rubber rolls under the same pressure as in the steamer body. A gas having a density heavier than air to be filled in the gas bodies may be replaced with air. The leakage of high temperature and high pressure steam in the steamer body through the inlet side and outlet side seal mechanisms can completely be prevented, and consequently, the seal mechanisms can be operated at the ordinary temperature without damaging the seal rubber rolls constituting the seal mechanisms.

7 Claims, 2 Drawing Figures

METHOD AND DEVICE FOR SEALING A HIGH PRESSURE STEAMER

BACKGROUND OF THE INVENTION

The present invention relates to a method for sealing a high pressure steamer for the use of continuous wet heat treatment of a long cloth produced commercially and a device therefor.

For the purpose of steaming a commercial long cloth continuously in subjecting the cloth to such treatments as pretreatment, weight reducing and dyeing, various kinds of high pressure steamers, in which seal mechanisms are provided at the cloth inlet and outlet thereof for allowing the taking in and out of a cloth to be treated continuously while maintaining the wet heat in the steamer body constant, have been proposed, particularly by the present applicant. The seal mechanisms in such already developed high pressure steamers are to provide a pair of seal rubber rolls pressed with each other respectively at the cloth inlet and the cloth outlet of the steamer body for sealing the steam in the steamer body while allowing the pass of the cloth continuously therethrough.

However, the seal rubber rolls in such a seal mechanism are exposed to the action of high temperature and pressure steam in the steamer body to elevate the surface temperature thereof, and consequently there occur such troubles that the rubber layer at the surface of the seal rubber roll is weakened or denatured to reduce the sealing effect and that the seal rubber roll is deformed due to expansion. Smooth taking in and out of the cloth becomes difficult, and finally the operation of the seal rubber rolls becomes impossible.

Although there have been many proposals for the improvement of the seal mechanism to dissolve such drawbacks, it is quite difficult to maintain the temperature of the seal rubber rolls as low as the ordinary temperature (about 20° C.) during operation. Since the temperature of the interior of the steamer body is usually as high as from 150° to 160° C., it is the present status that the temperature of the seal rubber rolls in the seal mechanism of a high pressure steamer is unavoidably about 50° C. at the lowest.

SUMMARY OF THE INVENTION

Under such circumstances, the object of the present invention is to offer a method of and a device for sealing a high pressure steamer for the use of continuous wet heat treatment of a long cloth, in which the inlet side and the outlet side seal rubber rolls can be operated at the ordinary temperature by preventing the leakage of the high temperature and high pressure steam in the steamer body thereto.

The principle of the invention comprises providing a cloth passage and a gas body in succession respectively between the cloth inlet and outlet of the steamer body and the inlet side and outlet side seal rubber rolls and filling them respectively with a gas having a density heavier than air at the ordinary temperature under the same pressure as in the steamer body for preventing the heating of the seal rubber rolls. A gas having a density heavier than air to be filled in the gas bodies may be replaced with air.

DETAILED DESCRIPTION OF THE PREFERRED EMBODIMENTS

Figure 1:
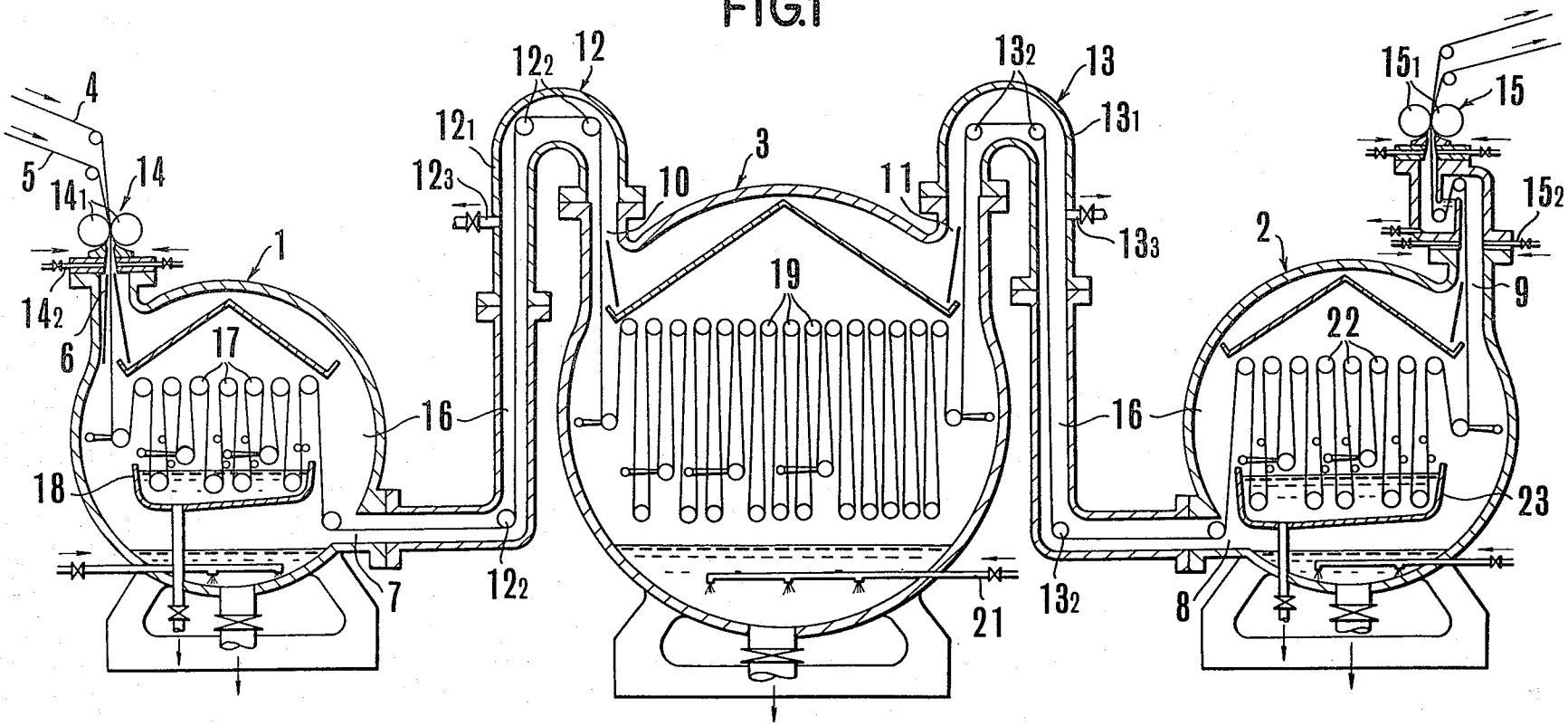
FIG. 1 is a sectional side view of an example of the high pressure steamer provided with the present inventive sealing device.

Preferred embodiments of the present invention will be described in detail in the following by referring to the drawings.

Figure 2:
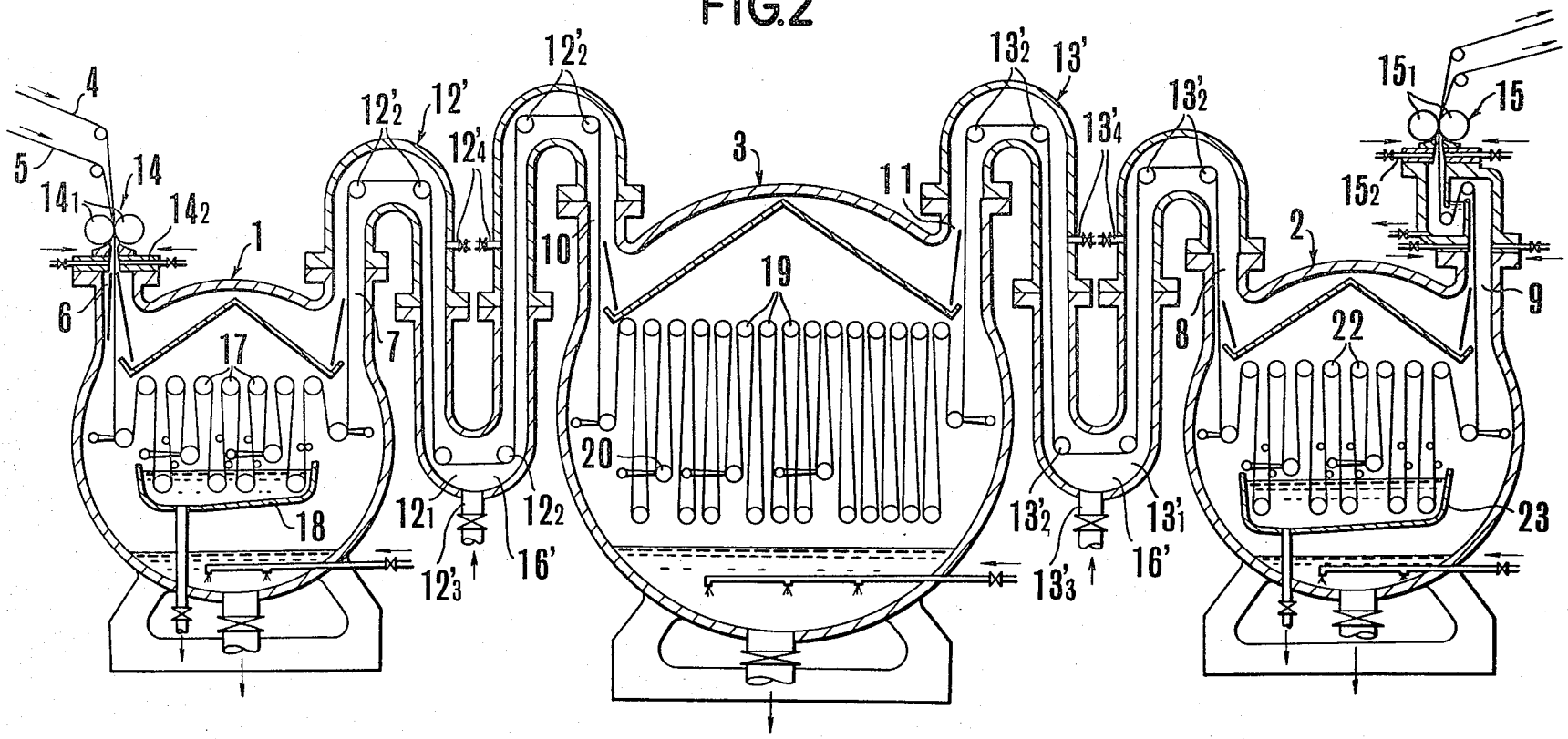
FIG. 2 is a sectional side view of a modification thereof.

In FIG. 1, 1 and 2 are gas bodies and 3 is a steamer body. The gas body 1 is provided with a cloth inlet 6 and cloths 4, 5 outlet 7 for transporting a cloth to be treated continuously therethrough, and the gas body 2 is provided similarly with a cloth inlet 8 and a cloth outlet 9. The steamer body 3 is also provided with a cloth inlet 10 and a cloth outlet 11. The gas body 1, the steamer body 3 and the gas body 2 are arranged successively in series. The steamer body may be divided into two or more chambers. The cloth outlet 7 of the gas body 1 and the cloth inlet 10 of the steamer body 3 is connected with a cloth passage 12 so as to pass the cloth continuously therethrough, and the cloth outlet 11 of the steamer body 3 and the cloth inlet 8 of the gas body 2 is connected similarly with a cloth passage 13. The cloth passage 12 has an upwardly extending part $\mathbf{12}_1$ higher than the top of the gas body 1, and the cloth passage 13 also has an upwardly extending part $\mathbf{13}_1$ higher than the top of the gas body 2.

The cloth inlet 6 of the gas body 1 and the cloth outlet 9 of the gas body 2 are provided respectively with a seal mechanism 14 and 15 for transporting the cloths continuously therethrough while maintaining the interior of the high pressure steamer with steam under prescribed high temperature and pressure. As the seal mechanisms 14 and 15, any one disclosed by the present applicant may be applied, but the seal mechanism 14 and 15 in this example comprise respectively a pair of seal rubber rolls $\mathbf{14}_1$ and $\mathbf{15}_1$ pressed against one another, and gas supply pipes $\mathbf{14}_2$ and $\mathbf{15}_2$ are attached thereto for supplying a gas having a density heavier than air into the gas bodies and the cloth passages under pressure. 16 denotes the gas heavier than air. $\mathbf{12}_3$ and $\mathbf{13}_3$ are, respectively, a gas exhaust pipe at the upper part of the cloth passages 12 and 13 for blowing out the gas occasionally.

$\mathbf{12}_2$ and $\mathbf{13}_2$ are cloth guide rolls provided, respectively, in the cloth passages 12 and 13. 17 are a plurality of cloth guide rolls provided in the gas body 1 for transporting the cloths 4 and 5 up and down zigzag continuously therethrough while immersing the cloth in a treating solution such as a pretreating solution or a dye solution stored in a liquid tank 18. 19 are a plurality of cloth guide rolls provided in the steamer body 3 for transporting the cloths 4 and 5 up and down zigzag continuously therethrough while wet heat treating the cloths due to the effect of high temperature and pressure steam in the steamer body for pretreating or dyeing the cloths. 20 are tension control rolls provided at proper positions, and 21 is a steam pipe for supplying a superheated steam in the steamer body 3. 22 are a plurality of cloth guide rolls provided in the gas body 2 for transporting the cloths 4 and 5 up and down zigzag continuously therethrough while washing the cloths with a washing liquid stored in a washing tank 23. By the way, the cloth guide rolls provided in the gas bodies 1 and 2 and in the steamer body 3 may freely be substituted under circumstances with such means as a conveyer.

Wet heat treatment, for instance dyeing, of a long cloth continuously by using this apparatus is done, for instance, as follows.

In the first place, a gas having a density heavier than air such as carbon dioxide, argon and butane is supplied through the gas supply pipes $\mathbf{14}_2$ and $\mathbf{15}_2$ into the gas bodies 1 and 2 for maintaining the two bodies at a pressure of, for instance, about 5 kg/cm$^2$ with the gas, and simultaneously superheated steam is supplied through the steam pipe 21 into the steamer body 3 for maintaining the steamer body at the same pressure as in the gas bodies, for instance at about 5 kg/cm$^2$, with steam. Then, cloths 4 and 5 to be treated are transported through the high pressure steamer continuously. The cloths 4 and 5 are soaked with a treating solution, for instance a dye solution, previously stored in the liquid tank 18 provided in the gas body 1, wet heat treated in the steamer body 3 and washed with a washing solution stored in the washing tank 23 provided in the gas body 2.

The gas bodies 1 and 2 are filled with a gas having a density heavier than air, for instance carbon dioxide, by maintaining the inner pressure thereof at a prescribed pressure (about 5 kg/cm$^2$) with the aid of the seal mechanisms 14 and 15, greater parts of the cloth passages 12 and 13 are filled also with the heavier gas, and the upper parts thereof are filled with steam, which has a density much lighter than such a gas as carbon dioxide, at the prescribed temperature under the same pressure as in the gas bodies, so that the steam at an elevated temperature in the steamer body does not flow in the gas bodies, and the gas bodies 1 and 2 as well as the seal mechanisms 14 and 15 can be kept at the ordinary temperature. The treating solution in the liquid tank 18 is also not diluted. Although the gas heavier than air and steam diffuse with each other slowly to some extent in the cloth passages 12 and 13, the mixed gas can preferably be blown out through the gas exhaust pipes $\mathbf{12}_3$ and $\mathbf{13}_3$ occasionally in case of need. In this way, the seal rubber rolls $\mathbf{14}_1$ and $\mathbf{15}_1$ constituting the seal mechanisms 14 and 15 can be operated at the ordinary temperature.

FIG. 2 shows a modification of the preceding high pressure steamer for substituting the gas having a density heavier than air in the gas bodies 1 and 2 with air. What is different from the above example is the construction of the cloth passages, and the constructions of the other parts of the apparatus are the same as before.

In the figure, 12' is a U-shaped cloth passage connecting the cloth outlet 7 of the gas body 1 and the cloth inlet 10 of the steamer body 3 for transporting the cloth continuously therethrough, and 13' is another U-shaped cloth passage connecting the cloth outlet 11 of the steamer body 3 and the cloth inlet 8 of the gas body 2 similarly. $\mathbf{12}_2'$ and $\mathbf{13}_2'$ are cloth guide rolls provided respectively in the cloth passages 12' and 13'. Each of $\mathbf{12}_3'$ and $\mathbf{13}_3'$ is respectively a gas supply pipe provided at the bottom of the cloth passages 12' and 13', and $\mathbf{12}_4'$ and $\mathbf{13}_4'$ are respectively gas exhaust pipes provided at the upper parts of the cloth passages 12' and 13'. 16' denotes the gas heavier than air.

Air is supplied through the gas supply pipes $\mathbf{14}_2$ and $\mathbf{15}_2$ into the gas bodies 1 and 2, superheated steam is supplied through the steam pipe 21 into the steamer body 3, and simultaneously a gas heavier than air, for instance carbon dioxide, is supplied through the gas supply pipes $\mathbf{12}_3'$ and $\mathbf{13}_3'$ in the cloth passages 12' and 13' so as the gas heavier than air balances, respectively, with air and steam at the upper parts of the cloth passages 12' and 13' under a prescribed pressure at about 5 kg/cm$^2$. Wet heat treatment of a long cloth continuously can be done as in the preceding example. The mixed gases produced slowly at the upper parts of the cloth passages 12' and 13' during operation are preferably blown out through the gas exhaust pipes $\mathbf{12}_4'$ and $\mathbf{13}_4'$ occasionally in case of need.

As described in detail in the above, the present invention comprises, in a high pressure steamer for the use of continuous wet heat treatment of a long cloth, providing a cloth passage, in which a gas having a density heavier than air is filled, and a gas body, in which a gas heavier than air or air is filled, in succession respectively between the cloth inlet and outlet of the steamer body and the inlet side and outlet side seal mechanisms consisting of a pair of seal rubber rolls. The gas having a density heavier than air and air to be supplied are at the ordinary temperature, and inner pressures of the steamer body, cloth passages and gas bodies are maintained in common at a prescribed pressure suitable for the wet heat treatment of the cloth. Therefore, the leakage of high temperature and pressure steam in the steamer body to the inlet side and outlet side seal mechanisms can be completely prevented, and consequently, the operation of the seal mechanisms can be done at the ordinary temperature without damaging the seal rubber rolls constituting the seal mechanisms.

What is claimed is:

1. A method of sealing a high pressure steamer for the continuous wet heat treatment of a cloth, comprising a steamer body having an inlet and an outlet, a first gas body having an inlet and an outlet, a second gas body having an inlet and an outlet, a first cloth passage connects the outlet of said first gas body to the inlet of said steamer body, a second cloth passage connects the inlet to said second gas body to the outlet of said steamer body, a seal mechanism connected to the inlet to said first gas body and another seal mechanism connected to the outlet from said second gas body, each said seal mechanism comprising a pair of seal rubber rolls, wherein the method comprises the steps of passing a cloth through the seal mechanism into said first gas body and then successively through the first cloth passage, the steamer body, the second cloth passage, the second gas body and out of the another seal mechanism from the second gas body, providing steam at an elevated temperature and pressure within said steamer body, filling a gas having a density heavier than air and a pressure the same as the steam in the steamer body into or at least the first and second cloth passages for preventing the leakage of the high temperature and high pressure steam from the steamer body through the first and second gas bodies to the seal mechanisms.

2. A method, as set forth in claim 1, including using as the gas having a density heavier than air to be filled at least into the gas passages, one selected from the group consisting of carbon dioxide, argon and butane.

3. A method, as set forth in claim 1, including filling the gas having a density heavier than air and at a pressure the same as the steam in the steamer body into the first and second gas bodies so that the gas flows into the first and second cloth passages.

4. A method, as set forth in claim 1, including filling the gas having a density heavier than air and at a pressure the same as the steam in the steamer body into the first and second gas passages and filling air in place of the gas into the first and second gas bodies.

5. A device for sealing a high pressure steamer for the continuous wet heat treatment of a cloth, comprises a steamer body arranged to contain steam at an elevated temperature and an elevated pressure, said steamer body having an inlet and an outlet, a first gas body having an inlet and an outlet, a second gas body having an inlet and an outlet, a first cloth passage connects the outlet of said first gas body to the inlet of said steamer body, a second cloth passage connects the inlet to said second gas body to the outlet of said steamer body, a first seal mechanism connected to the inlet to said first gas body and a second seal mechanism connected to the outlet from said second gas body, each of said first and second seal mechanisms includes a pair of seal rubber rolls, means for guiding cloth through said seal rubber rolls in said first seal mechanism into said first gas body and then successively through said first cloth passage, said steamer body, said second cloth passage, said second gas body and out of said second seal mechanism passing through said seal rubber rolls in said second seal mechanism, means for supplying steam at an elevated temperature and pressure into said steamer body, means for introducing a gas having a density heavier than air and at a pressure the same as the steam in said steamer body into at least said first and second cloth passages so that the gas in the first and second cloth passages prevents the leakage of the high temperature and high pressure steam from the steamer body into the first and second seal bodies and out of the seal mechanisms.

6. A device, as set forth in claim 5, wherein each of said first and second cloth passages has an upwardly extending part with the upper end thereof located above the top of the associated said gas body so that the gas having a density heavier than air can be filled into said first and second cloth passages and said first and second gas bodies.

7. A device, as set forth in claim 5, wherein said first cloth passage intermediate the outlet from said first gas body and the inlet into said steamer body and said second cloth passage intermediate the outlet from said steamer body and the inlet into said second gas body are U-shaped for filling the first and second cloth passages with a gas having a density heavier than air and means at said seal mechanisms for supplying air into said first and second gas bodies.

* * * * *